US010858805B2

(12) United States Patent
Takahashi et al.

(10) Patent No.: US 10,858,805 B2
(45) Date of Patent: Dec. 8, 2020

(54) CONSTRUCTION MACHINE

(71) Applicant: Hitachi Construction Machinery Co., Ltd., Tokyo (JP)

(72) Inventors: Hiromasa Takahashi, Abiko (JP); Shohei Sugiki, Tsuchiura (JP); Kenji Hiraku, Kasumigaura (JP); Juri Shimizu, Hitachinaka (JP); Teppei Saitoh, Mito (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 16/493,013

(22) PCT Filed: Jan. 16, 2018

(86) PCT No.: PCT/JP2018/001062
§ 371 (c)(1),
(2) Date: Sep. 11, 2019

(87) PCT Pub. No.: WO2019/142244
PCT Pub. Date: Jul. 25, 2019

(65) Prior Publication Data

US 2020/0115887 A1 Apr. 16, 2020

(51) Int. Cl.
*E02F 9/22* (2006.01)
*F15B 11/02* (2006.01)
(Continued)

(52) U.S. Cl.
CPC ..... *E02F 9/2242* (2013.01); *E02F 3/425* (2013.01); *E02F 3/435* (2013.01); *E02F 9/2004* (2013.01);
(Continued)

(58) Field of Classification Search
CPC ..... E02F 9/2242; E02F 9/2228; E02F 9/2235; F15B 2011/0243
(Continued)

(56) References Cited

U.S. PATENT DOCUMENTS

2014/0366519 A1* 12/2014 Sadamori ..... E02F 9/2207 60/430

FOREIGN PATENT DOCUMENTS

JP 2005-76781 A 3/2005
WO WO 2013/115140 A1 8/2013

OTHER PUBLICATIONS

International Search Report (PCT/ISA/210) issued in PCT Application No. PCT/JP2018/001062 dated Feb. 27, 2018 with English translation (five pages).
(Continued)

*Primary Examiner* — Thomas E Lazo
*Assistant Examiner* — Daniel S Collins
(74) *Attorney, Agent, or Firm* — Crowell & Moring LLP

(57) ABSTRACT

A construction machine is provided which includes a hydraulic closed circuit in which a single rod hydraulic cylinder is driven directly by a bidirectionally tiltable variable displacement pump and can stably speed up the contraction action of the single rod hydraulic cylinder. In the case where a contraction action of a hydraulic cylinder 10 is instructed through an operation lever 30, when a differential pressure obtained by subtracting the pressure of a cap chamber 10*a* from the pressure of a rod chamber 10*b* is equal to or lower than a first threshold value a set to a level equal to or higher than a selection setting pressure of a flushing valve 14, a controller 20 closes a rod side selector valve 12*b* to disable rod assist action for supplying hydraulic fluid from a second hydraulic pump 8 to the rod chamber, and when the differential pressure is higher than the first
(Continued)

threshold value, the controller 20 opens the rod side selector valve to enable the rod assist action.

5 Claims, 8 Drawing Sheets

(51) Int. Cl.
*E02F 3/42* (2006.01)
*E02F 3/43* (2006.01)
*E02F 9/20* (2006.01)
*E02F 3/32* (2006.01)

(52) U.S. Cl.
CPC ..... *E02F 9/2228* (2013.01); *E02F 9/2235* (2013.01); *E02F 9/2267* (2013.01); *E02F 9/2271* (2013.01); *E02F 9/2275* (2013.01); *E02F 9/2292* (2013.01); *E02F 9/2296* (2013.01); *F15B 11/02* (2013.01); *E02F 3/32* (2013.01)

(58) Field of Classification Search
USPC ..... 60/455, 461, 464
See application file for complete search history.

(56) References Cited

OTHER PUBLICATIONS

Japanese-language Written Opinion (PCT/ISA/237) issued in PCT Application No. PCT/JP2018/001062 dated Feb. 27, 2018 (four pages).

International Preliminary Report on Patentability (PCT/IB/338 & PCT/IB/373) issued in PCT Application No. PCT/JP2018/001062 dated Jul. 30, 2020, including English translation of document C2 (Japanese-language Written Opinion (PCT/ISA/237) previously filed on Sep. 11, 2019) (seven (7) pages).

* cited by examiner

CONSTRUCTION MACHINE

TECHNICAL FIELD

The present invention relates to a construction machine that includes a hydraulic closed circuit in which a hydraulic actuator is driven directly by a hydraulic pump.

BACKGROUND ART

In recent years, energy saving is an important development item in a construction machine such as a hydraulic excavator or a wheel loader. For energy saving of a construction machine, energy saving of a hydraulic system is effective. Therefore, application of a hydraulic circuit (hereinafter referred to as "hydraulic closed circuit") that connects a hydraulic pump of the bidirectionally tiltable type and a hydraulic actuator to each other without a throttle valve interposed therebetween such that the hydraulic actuator is directly driven by the hydraulic pump is under consideration. In the hydraulic closed circuit, since pressure loss by a throttle valve does not occur and the hydraulic pump delivers only a flow rate required by the hydraulic actuator, flow rate loss by shunting does not occur. Therefore, a hydraulic system to which the hydraulic closed circuit is applied can achieve energy saving rather than a conventional hydraulic system.

A hydraulic closed circuit is disclosed, for example, in Patent Document 1. Patent Document 1 discloses a drive system for a work machine in which a fluid pressure actuator (hereinafter referred to as single rod hydraulic cylinder) and a bidirectionally tiltable variable displacement pump (hereinafter referred to as open circuit pump) are directly coupled to each other, and hydraulic fluid of a unidirectionally tiltable variable displacement pump (hereinafter referred to as closed circuit pump) can be supplied into a bottom chamber (hereinafter referred to as cap chamber) or a rod chamber of the single rod hydraulic cylinder. The hydraulic closed circuit includes a flushing valve that communicates the low pressure side of two hydraulic lines (hereinafter referred to as a cap side hydraulic line and a rod side hydraulic line) for connecting the closed circuit pump and the single rod hydraulic cylinder to each other with an fluid tank to absorb a flow rate difference between the cap side hydraulic line and the rod side hydraulic line.

PRIOR ART DOCUMENT

Patent Document

Patent Document 1: JP-2005-76781-A

SUMMARY OF THE INVENTION

Problem to be Solved by the Invention

According to the drive system for a work machine disclosed in Patent Document 1, a cylinder contraction action can be speeded up by supplying hydraulic fluid of the open circuit pump into the rod chamber of the single rod hydraulic cylinder (rod assist action).

However, depending upon the timing at which a rod assist action is started, the cap side hydraulic line is not communicated as yet with the fluid tank through the flushing valve and surplus fluid of the cap side hydraulic line cannot be returned into the fluid tank through the flushing valve. As a result, the pressure (back pressure) in the cap chamber increases excessively, resulting in the possibility that the cylinder contraction action cannot be speeded up stably.

The present invention has been made in view of such a problem as described above, and the object of the present invention resides in provision of a construction machine including a hydraulic closed circuit in which a single rod hydraulic cylinder is driven directly by a bidirectionally tiltable variable displacement pump and can stably speed up the contraction action of the single rod hydraulic cylinder.

Means for Solving the Problem

In order to achieve the object described above, according to the present invention, there is provided a construction machine including: a single rod hydraulic cylinder having a cap chamber and a rod chamber; a first hydraulic pump that is a bidirectionally tiltable variable displacement pump; a cap side hydraulic line that connects one delivery port of the first hydraulic pump and the cap chamber to each other; a rod side hydraulic line that connects another delivery port of the first hydraulic pump and the rod chamber to each other; a fluid tank; a flushing valve that discharges surplus fluid of one of the cap side hydraulic line and the rod side hydraulic line, that one is on a low pressure side, to the fluid tank; a second hydraulic pump that is a unidirectionally tiltable variable displacement pump; a rod side selector valve that communicates a delivery port of the second hydraulic pump and the rod chamber with each other or interrupts the communication; an operation lever for instructing an action of the hydraulic cylinder; a cap pressure sensor that detects a pressure of the cap chamber; a rod pressure sensor that detects a pressure of the rod chamber; and a controller for controlling the first hydraulic pump, the second hydraulic pump, and the rod side selector valve based on inputs from the operation lever, the cap pressure sensor, and the rod pressure sensor. The controller is configured to, in a case where a contraction action of the hydraulic cylinder is instructed through the operation lever, close the rod side selector valve to disable a rod assist action for supplying hydraulic fluid from the second hydraulic pump to the rod chamber when a differential pressure obtained by subtracting the pressure of the cap chamber from the pressure of the rod chamber is equal to or lower than a first threshold value set to a level equal to or higher than a selection setting pressure of the flushing valve, and open the rod side selector valve to enable the rod assist action when the differential pressure is higher than the first threshold value.

According to the present invention configured in such a manner as described above, in the case where the single rod hydraulic cylinder is operated in the contraction direction, when the cap chamber of the single rod hydraulic cylinder is not communicated with the fluid tank through the flushing valve, the rod assist action is disabled, and when the cap chamber is communicated with the fluid tank through the flushing valve, the rod assist action is enabled. Consequently, immediately after the rod assist action is started, part of the discharge flow rate of the cap chamber begins to be returned to the fluid tank through the flushing valve, and therefore, increase of the cap pressure is suppressed. As a result, it becomes possible to stably speed up the contraction action of the single rod hydraulic cylinder.

Advantages of the Invention

According to the present invention, it is possible, in a construction machine that includes a hydraulic closed circuit in which a single rod hydraulic cylinder is directly driven by a bidirectionally tiltable variable displacement pump, to speed up the contraction action of the single rod hydraulic cylinder stably.

MODE FOR CARRYING OUT THE INVENTION

Figure 1:
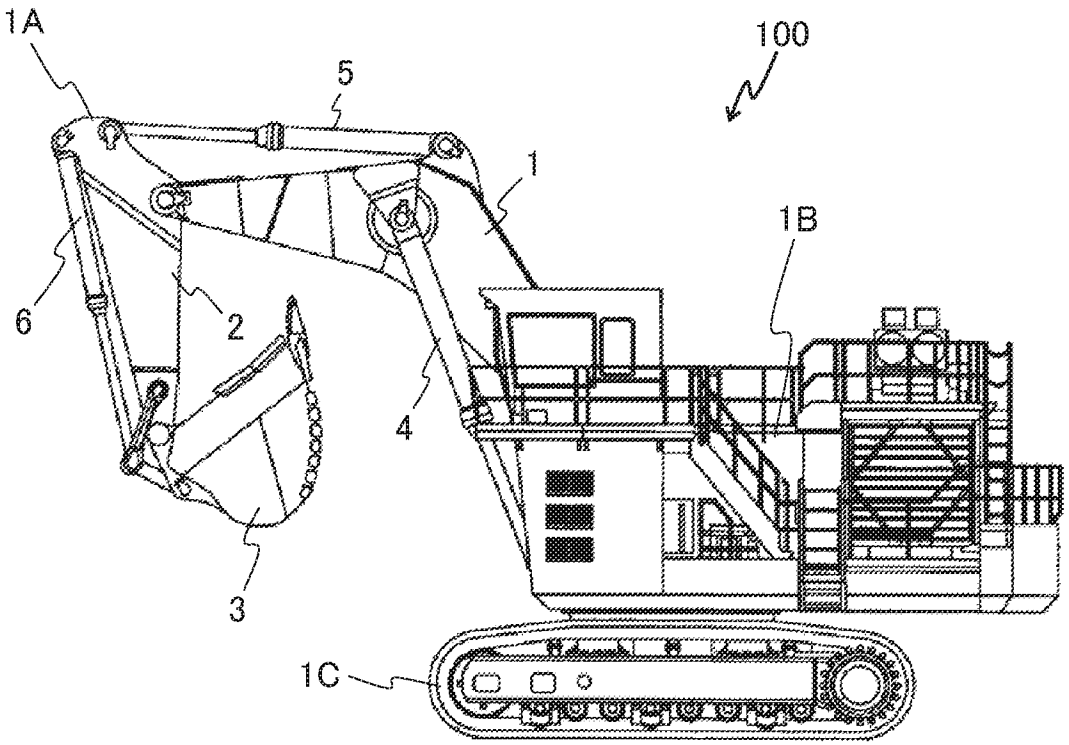
FIG. 1 is a side elevational view of a hydraulic excavator as an example of a construction machine according to an embodiment of the present invention.

In the following, a construction machine according to an embodiment of the present invention is described with reference to the drawings taking a hydraulic excavator as an example. It is to be noted that like members in the figures are denoted by like reference characters and overlapping description of them is suitably omitted herein.

FIG. 1 is a side elevational view of the hydraulic excavator according to the present embodiment.

As depicted in FIG. 1, a hydraulic excavator 100 includes a lower track structure 1C, an upper swing structure 1B mounted for swinging motion on the lower track structure 1C, and a front implement 1A attached for pivotal motion in upward and downward directions to the front side of the upper swing structure 1B. The lower track structure 1C is driven to travel by a traveling motor not depicted, and the upper swing structure 1B is driven to swing by a swing motor not depicted.

The front implement 1A includes a boom 1, an arm 2, a bucket 3, a single rod hydraulic cylinder 4, another single rod hydraulic cylinder 5, and a further single rod hydraulic cylinder 6. The boom 1 is attached at a proximal end portion thereof for pivotal motion in upward and downward directions at a front portion of the upper swing structure 1B. The arm 2 is attached for pivotal motion in upward and downward directions and forward and rearward directions to a distal end portion of the boom 1. The bucket 3 is attached for pivotal motion in upward and downward directions and forward and rearward directions to a distal end portion of the arm 2. The single rod hydraulic cylinder (hereinafter referred to as "boom cylinder") 4 drives the boom 1. The single rod hydraulic cylinder (hereinafter referred to as "arm cylinder") 5 drives the arm 2. The single rod hydraulic cylinder (hereinafter referred to as "bucket cylinder") 6 drives the bucket 3. In a cab of the hydraulic excavator 100, an operation lever 30 (depicted in FIG. 2) for instructing actions for the hydraulic cylinders 4 to 7 is installed.

WORKING EXAMPLE 1

A first working example of the present invention is described with reference to FIGS. 2 to 8.

Figure 2:
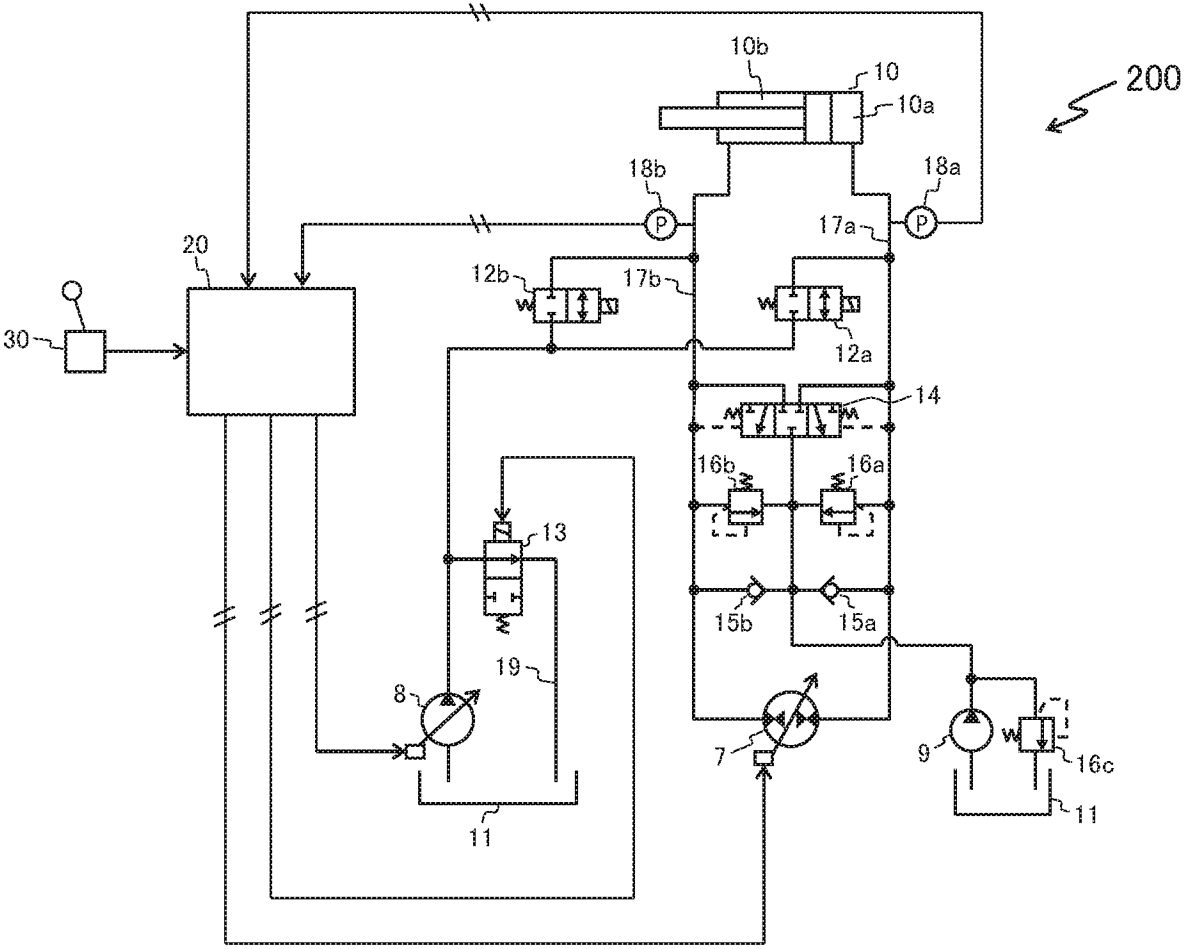
FIG. 2 is a view depicting a standby state of a drive system incorporated in the hydraulic excavator depicted in FIG. 1.

FIG. 2 is a view depicting a standby state of a drive system incorporated in the hydraulic excavator depicted in FIG. 1. In FIG. 2, the boom cylinder 4, the arm cylinder 5, and the bucket cylinder 6 depicted in FIG. 1 are depicted by a hydraulic cylinder 10 as a representative.

As depicted in FIG. 2, the drive system 200 includes a closed circuit pump (first hydraulic pump) 7, an open circuit pump (second hydraulic pump) 8, a charge pump 9, a hydraulic cylinder 10, a fluid tank 11, a cap side selector valve 12*a*, a rod side selector valve 12*b*, a proportional valve 13, a flushing valve 14, an operation lever 30, and a controller 20.

The closed circuit pump 7 that is a bidirectionally tiltable variable displacement pump, the open circuit pump 8 that is a unidirectionally tiltable variable displacement pump, and the charge pump 9 that is a unidirectionally tiltable fixed displacement pump are driven by a prime mover not depicted.

The closed circuit pump 7 is connected at one delivery port thereof to a cap chamber 10*a* of the hydraulic cylinder 10 through a cap side hydraulic line 17*a* and at another delivery port thereof to a rod chamber 10*b* of the hydraulic cylinder 10 through a rod side hydraulic line 17*b*. The closed circuit pump 7 directly drives the hydraulic cylinder 10 by sucking fluid from one of the cap chamber 10*a* and the rod chamber 10*b* of the arm cylinder 5 and delivering the fluid to the other of the cap chamber 10*a* and the rod chamber 10*b*. In other words, the closed circuit pump 7, the hydraulic cylinder 10, the cap side hydraulic line 17*a*, and the rod side hydraulic line 17*b* configure a closed circuit. In the cap side hydraulic line 17*a*, a cap side pressure sensor (cap pressure sensor) 18*a* for detecting the pressure of the cap chamber 10*a* (cap pressure) is provided, and in the rod side hydraulic line 17*b*, a rod side pressure sensor (rod pressure sensor) 18*b* for detecting the pressure of the rod chamber 10*b* (cap pressure) is provided.

The open circuit pump 8 is connected at a delivery port thereof to the cap side hydraulic line 17*a* through the cap side selector valve 12*a* and to the rod side hydraulic line 17*b* through the rod side selector valve 12*b*. When the cap side selector valve 12*a* performs an on or off action, the delivery port of the open circuit pump 8 and the cap chamber 10*a* are communicated with each other or the communication is interrupted, and when the rod side selector valve 12*b* performs an on or off action, the delivery port of the open circuit pump 8 and the rod chamber 10*b* are communicated with each other or the communication is interrupted. The open circuit pump 8 sucks fluid from the fluid tank 11 and supplies hydraulic fluid to the cap chamber 10*a* or the rod chamber 10*b* of the arm cylinder 5 through the selector valve 12*a* or 12*b*.

The proportional valve 13 is provided in a discharge hydraulic line 19 that is branched from the delivery hydraulic line of the open circuit pump 8 and is communicated with the fluid tank 11. The proportional valve 13 opens when the open circuit pump 8 is not used such that a delivery flow rate of the open circuit pump 8 is returned to the fluid tank 11. Further, the proportional valve 13 changes an opening area thereof continuously according to an operation amount of the operation lever 30 and adjusts a flow rate discharged from the cap chamber 10*a* to the fluid tank 11 to speed up a cylinder contraction action. The charge pump 9 sucks fluid from the fluid tank 11 and supplements the circuitry with the fluid through a check valve 15*a* or 15*b*. The flushing valve 14 discharges surplus fluid of one of the cap side hydraulic line 17*a* and the rod side hydraulic line 17*b*, that is the low pressure side, to the fluid tank 11. Main relief valves 16*a* and 16*b* set a maximum pressure for the circuitry, and a charge relief valve 16*c* sets a maximum pressure for the charge pump 9.

The controller 20 calculates, on the basis of the operation amount of the operation lever 30, pressure information of the pressure sensors 18*a* and 18*b*, and so forth, and outputs a delivery direction of the closed circuit pump 7, delivery flow rate commands for the closed circuit pump 7 and the open circuit pump 8, opening-closing commands for the selector valves 12*a* and 12*b*, and an opening command for the proportional valve 13.

As depicted in FIG. 2, in the standby state, the selector valve 12*a* is in a closed position and keeps the pressure in the cap chamber 10*a*. Meanwhile, the proportional valve 13 is in an open position and lets a standby flow rate of the open circuit pump 8 escape to the fluid tank 11 to prevent an increase of the pressure.

Now, an arm action is described.

In an extension action of the hydraulic cylinder 10, the closed circuit pump 7 sucks fluid from the rod side hydraulic line 17*b* and delivers the fluid to the cap side hydraulic line 17*a*. Further, the selector valve 12*a* is placed into its open position and the proportional valve 13 is placed into its closed position. Then, to the open circuit pump 8, a flow rate command for making up for the shortage of fluid in the cap chamber 10*a* caused by a delivery flow rate of the closed circuit pump 7 and the cylinder pressure receiving area difference is issued. Consequently, the cylinder extension action can be speeded up and flow rate balance of the circuitry can be anticipated.

In a contraction action of the hydraulic cylinder 10, the closed circuit pump 7 sucks fluid from the cap side hydraulic line 17*a* and delivers the fluid to the rod side hydraulic line 17*b*. Further, the selector valve 12*a* is placed into its open position, and the proportional valve 13 is opened according to the operation amount of the operation lever 30 such that a surplus flow rate discharged from the cap chamber 10*a* is discharged from the proportional valve 13. Consequently, the cylinder contraction action can be speeded up, and flow rate balance of the circuitry can be anticipated.

Figure 3:
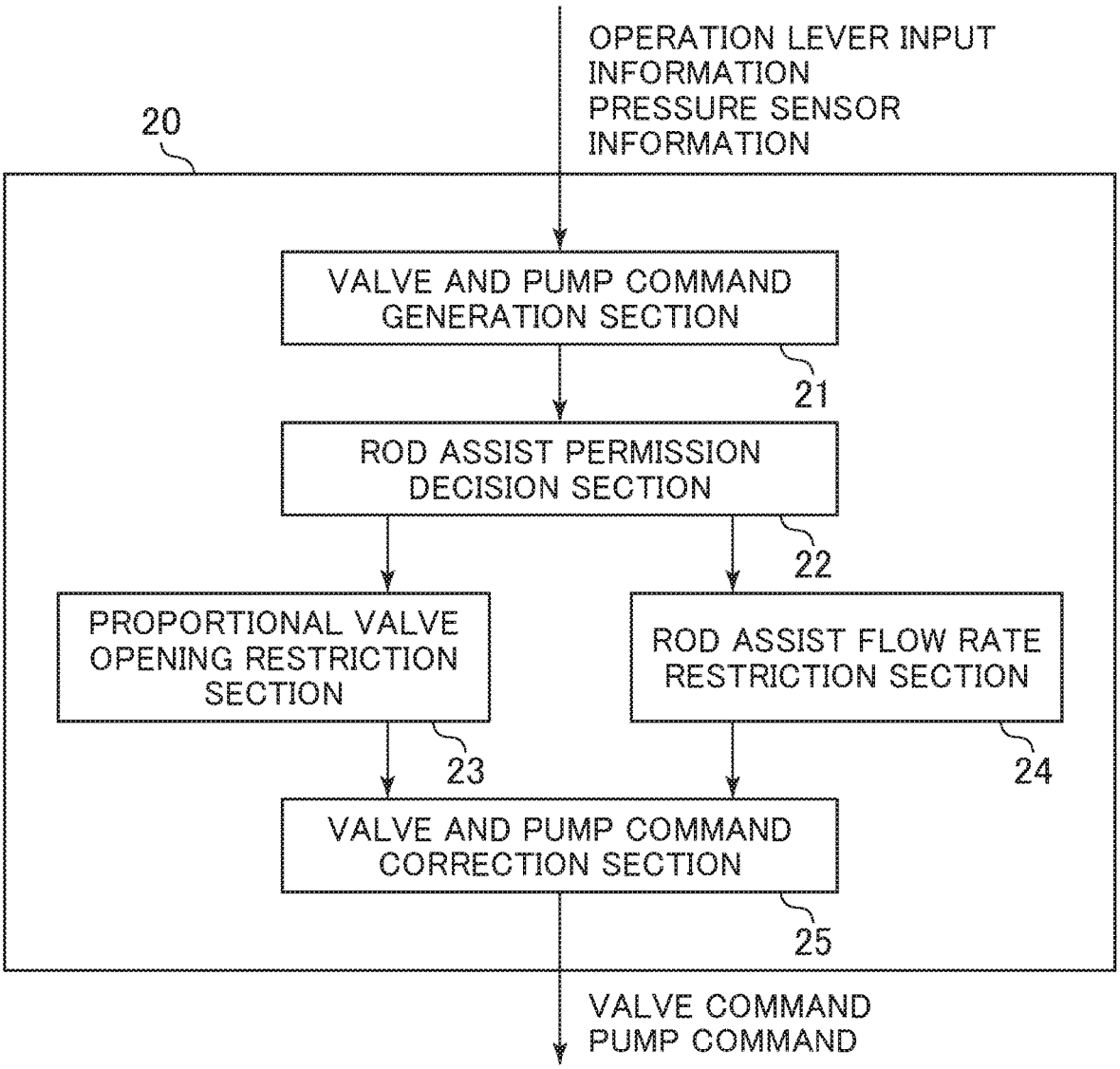
FIG. 3 is a functional block diagram of a controller depicted in FIG. 2.
Figure 4:
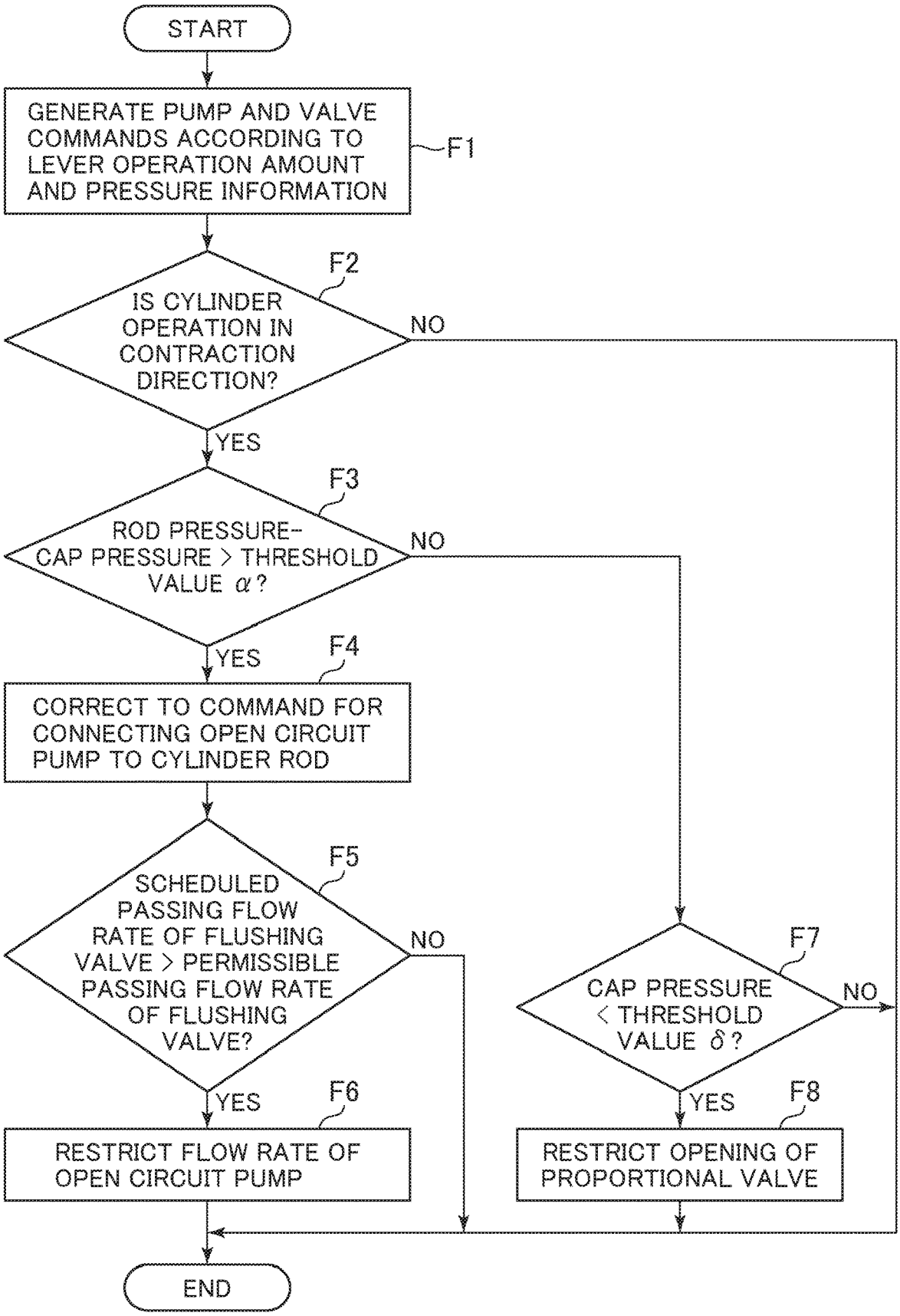
FIG. 4 is a flow chart depicting a flow of processing in one control cycle of the controller depicted in FIG. 2.

FIG. 3 is a functional block diagram of the controller 20, and FIG. 4 is a flow chart depicting a flow of processing in one control cycle of the controller.

As depicted in FIG. 3, the controller 20 includes a valve and pump command generation section 21, a rod assist permission decision section 22, a proportional valve opening restriction section 23, a rod assist flow rate restriction section 24, and a valve and pump command correction section 25. The controller 20 is configured from a CPU as a calculation section not depicted, a ROM and a RAM as storage sections, and other peripheral circuits and implements functions of various members by executing a program stored in the ROM by the CPU.

In a process F1 of FIG. 4, the valve and pump command generation section 21 generates a valve command and a pump command according to an operation amount of the operation lever 30 and pressure information of the pressure sensors 18*a* and 18*b*. In a next process F2, it is decided whether or not a cylinder action direction is a contraction direction. In the case where the cylinder action direction is the contraction direction, the processing advances to a process F3, but in any other case, the processing flow is ended. In the process F3, the rod assist permission decision section 22 performs a decision of whether or not a rod assist action for connecting the open circuit pump 8 to the rod chamber 10*b* to speed up a dumping action is to be started. For the decision, the cylinder pressure information is used. If the differential pressure obtained by subtracting the pressure of the cap chamber 10*a* from the pressure of the rod chamber 10*b* is higher than a predetermined threshold value (first threshold value) $\alpha$, then the rod assist permission decision section 22 decides that the open circuit pump 8 may be connected to the rod chamber 10*b*, and the processing advances to a process F4, but in any other case, the processing advances to a process F7. Here, the threshold value $\alpha$ is set to a value higher than a selection setting pressure $\beta$ of the flushing valve 14.

In the process F4 in the case where a rod assist action is performed, a command for connecting the open circuit pump 8 to the rod chamber 10*b* is generated. Then in a next process F5, the rod assist flow rate restriction section 24 performs calculation for suppressing a passing flow rate of the flushing valve 14 in order to suppress an increase of a rod pressure that increases as a result of the connection of the open circuit pump 8 to the rod chamber 10*b*. In particular, the rod assist flow rate restriction section 24 decides whether or not a scheduled passing flow rate value of the flushing valve 14 calculated from the pump flow rate command is greater than a permissible passing flow rate value set in advance. In the case where the scheduled passing flow rate value is greater, the processing advances to a process F6, in which the flow rate command for the open circuit pump 8 is restricted. The valve and pump command correction section 25 corrects the delivery flow rate command for the open circuit pump 8 generated by the valve and pump command generation section 21 in response to the flow rate command restricted by the rod assist flow rate restriction section 24. In the case where the scheduled passing flow rate value is equal to or lower than the permissible passing flow rate value, the processing flow is ended.

In the case where it is decided by the process F3 that the differential pressure obtained by subtracting the pressure of the cap chamber 10*a* from the pressure of the rod chamber 10*b* is equal to or lower than the threshold value $\alpha$, the processing advances to a process F7 without performing the rod assist action. In the process F7, the proportional valve opening restriction section 23 decides whether or not the pressure of the rod chamber 10*b* is lower than a threshold value set in advance. In the case where the pressure of the rod chamber 10*b* is lower than the threshold value, the processing advances to a process F8, where the opening command for the proportional valve 13 is restricted. The valve and pump command correction section 25 corrects the opening command for the proportional valve 13 generated by the valve and pump command generation section 21 in response to the opening command restricted by the proportional valve opening restriction section 23. In the case where the differential pressure is higher than the threshold value $\alpha$, the processing flow is ended.

On the basis of the command after such restrictions, the valve and pump command correction section 25 corrects and outputs the commands to the valves and the pumps.

An action of the hydraulic excavator 100 according to the present working example is described taking an action of dumping from a state in which the arm 2 is crowded in the air as an example.

In the process F1, commands for the pumps and the valves are generated according to a lever operation amount and a cylinder load pressure. As described hereinabove, to the closed circuit pump 7, a delivery flow rate command to the rod side hydraulic line 17*b* is generated according to an operation amount of the operation lever 30; to the selector valve 12*a*, an opening command is generated; to the selector valve 12*b*, a closing command is generated; and to the proportional valve 13, an opening command according to the command to the closed circuit pump 7 is generated.

In the process F2, decision of whether or not the cylinder operation direction is the contraction direction is performed. Since the arm dumping action corresponds to the cylinder contraction direction, the processing advances to the process F3. In the next process F3, it is decided whether or not the differential pressure obtained by subtracting the pressure of the cap chamber 10*a* from the pressure of the rod chamber 10*b* is higher than the positive threshold value α. Since, in the posture in which the arm 2 is crowded, the pressure of the cap chamber 10*a* is sufficiently higher than the pressure of the rod chamber 10*b*, the decision criterion of the process F3 is not satisfied, and the processing advances to the process F7. In the process F7, it is decided whether or not the pressure of the cap chamber 10*a* is lower than a predetermined threshold value (second threshold value) δ. In the present working example, it is decided that the decision criterion is not satisfied, and the processing flow is ended. An action in the case where it is decided that the cap pressure is lower than the threshold value δ and the process F8 is performed is described in the description of a second working example.

Figure 5:
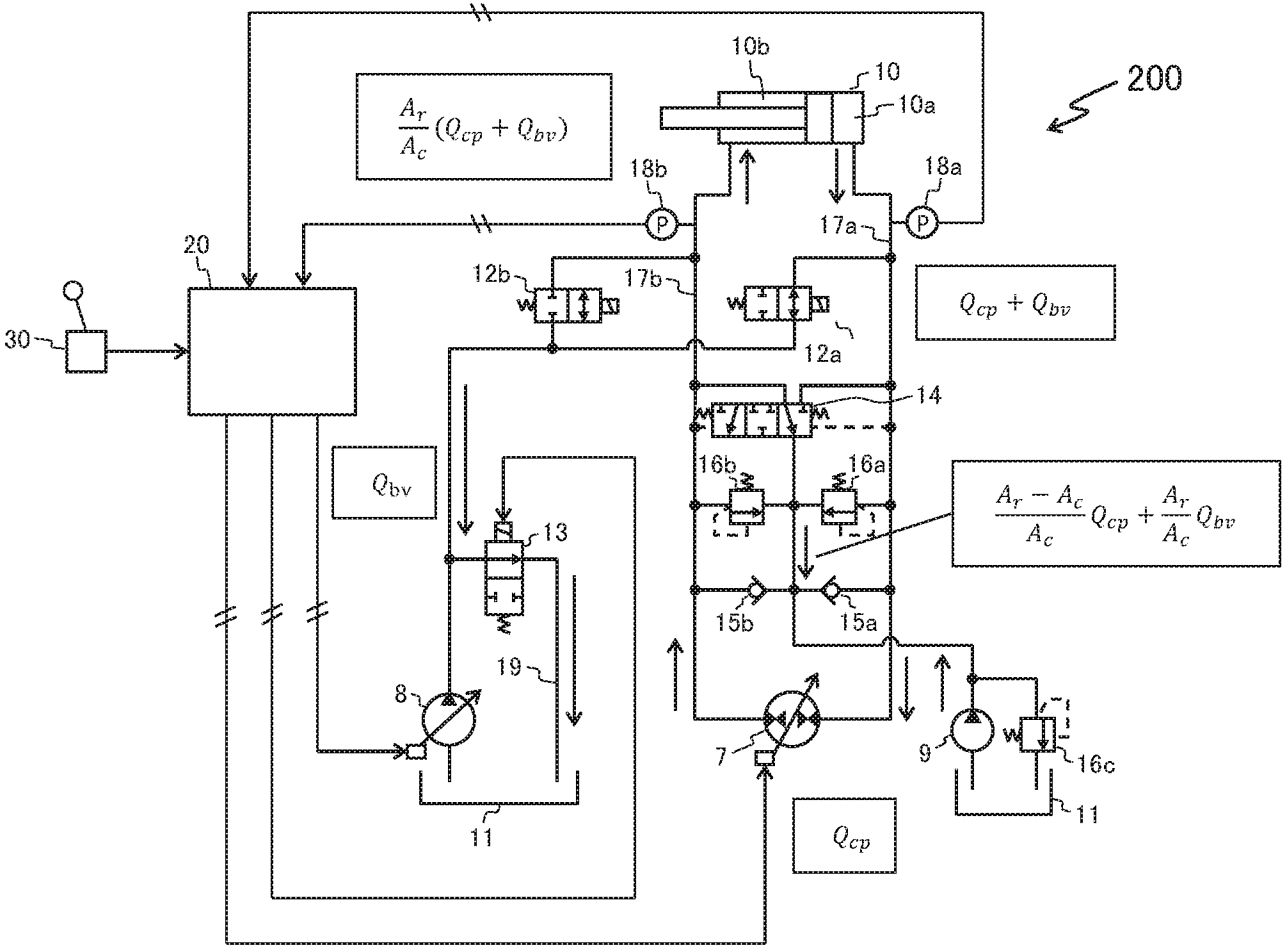
FIG. 5 is a view depicting a state when a rod assist action of the drive system depicted in FIG. 2 is not being performed.

A state of the drive system 200 in the case where it is decided in the process F3 that the differential pressure obtained by subtracting the cap pressure from the rod pressure is equal to or lower than the threshold value α (that is, when a rod assist action is not performed) is depicted in FIG. 5. If the delivery flow rate of the closed circuit pump 7 is represented by Qcp and the discharge flow rate of the proportional valve 13 is represented by Qbv, then since the flow rate that flows out from the cap chamber 10*a* is Qcp+Qbv, if the pressure receiving areas of the cap chamber 10*a* and the rod chamber 10*b* are represented by Ac and Ar, respectively, then the flow rate that flows into the rod chamber 10*b* is given by

[Expression 1]

$$Ar/Ac\times(Qcp+Qbv) \quad (1)$$

Here, since the closed circuit pump 7 delivers, simultaneously when it sucks the flow rate of Qcp from the cap chamber 10*a*, an equal flow rate of fluid to the rod chamber 10*b*, the flow rate passing the flushing valve 14 is given by

[Expression 2]

$$Ar/Ac\times(Qcp+Qbv)-Qcp=(Ar-Ac)/Ac\times Qcp+Ar/Ac\times Qbv \quad (2)$$

Here, if Ar=1 and Ac=2 are assumed for the simplified description, then the expression (2) is represented as

[Expression 3]

$$-1/2\times Qcp+1/2\times Qbv \quad (3)$$

Thus, it can be recognized that the flow rates of the proportional valve 13 and the closed circuit pump 7 cancel each other, resulting in the passing flow rate of the flushing valve 14. Therefore, the pressure loss of the flushing valve 14 is small and the rod pressure tends to be less likely to increase. For example, if Qcp=100 and Qbv=100 are satisfied, then the value of the expression (2) becomes zero and no fluid flows through the flushing valve 14.

If the arm dumping action continues and the own weight acts in the cylinder contraction direction until the differential pressure obtained by subtracting the cap pressure from the rod pressure becomes higher than the threshold value α, then the processing advances to the process F4 as a result of the decision in the process F3.

In the process F4, a command for connecting the open circuit pump 8 to the rod chamber 10*b* is generated. In particular, a command for closing the selector valve 12*a*, opening the selector valve 12*b*, and closing the proportional valve 13 is generated. Consequently, it becomes possible to feed the delivery flow rate of the open circuit pump 8 into the rod chamber 10*b* to speed up the arm dumping action.

Figure 6:
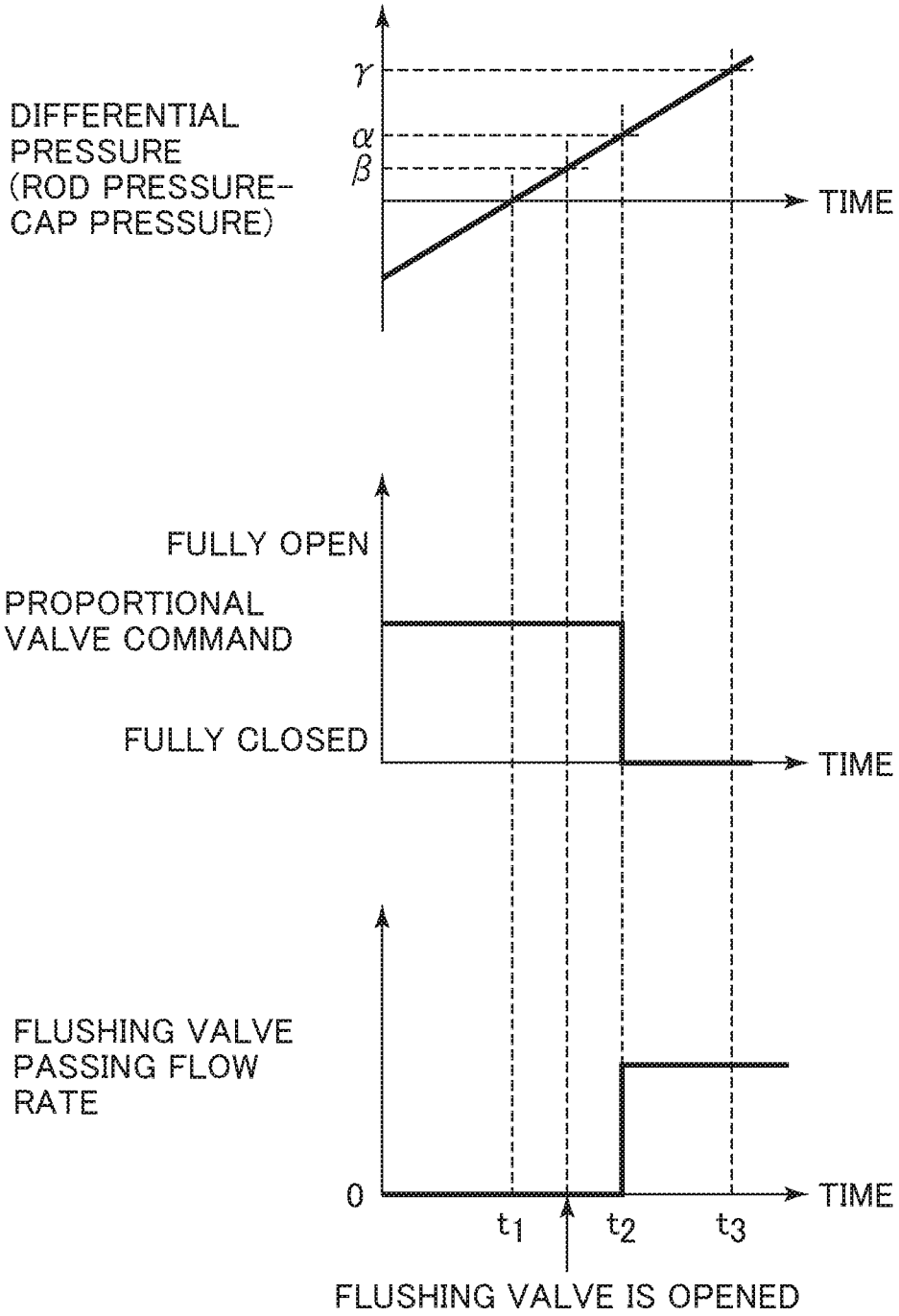
FIG. 6 is a view depicting an example of calculation of a rod assist permission decision section depicted in FIG. 3.

Here, the reason why the threshold value α is provided in the process F3 is described with reference to FIGS. 5 and 6. FIG. 6 is a view depicting an example of calculation of the rod assist permission decision section 22.

Referring to FIG. 5, the delivery flow rate of the closed circuit pump 7 in a state in which the open circuit pump 8 is connected to the rod chamber 10*b*, namely, immediately before the proportional valve 13 is closed, is represented as Qcp. At this time, if the proportional valve 13 is closed at time t1 at which the pressure of the rod chamber 10*b* and the pressure of the cap chamber 10*a* are equal to each other, then since Qbv=0 is satisfied, the discharge flow rate from the cap chamber 10*a* becomes Qcp. On the other hand, since the pressures of the rod chamber 10*b* and the cap chamber 10*a* are equal to each other, the flushing valve 14 is in its neutral position. Therefore, the discharge flow rate Qcp from the cap chamber 10*a* cannot be discharged from the flushing valve 14 to the fluid tank 11, and the cap pressure increases. Consequently, the displacement of the flushing valve 14 is returned so as to open to the rod side hydraulic line 17*b*, resulting in instability of the cylinder action.

Therefore, the proportional valve 13 is closed at time t2 at which the differential pressure obtained by subtracting the cap pressure from the rod pressure coincides with the threshold value α as depicted in FIG. 6. Here, since the threshold value α is set to a value higher than the selection setting pressure β of the flushing valve 14 and, at time t2, the flushing valve 14 is displaced sufficiently so as to open to the cap side hydraulic line 17*a*, the flow rate Qcp from the cap chamber 10*a* can be discharged by the flushing valve 14, and excessive increase of the cap pressure can be suppressed.

Figure 7:
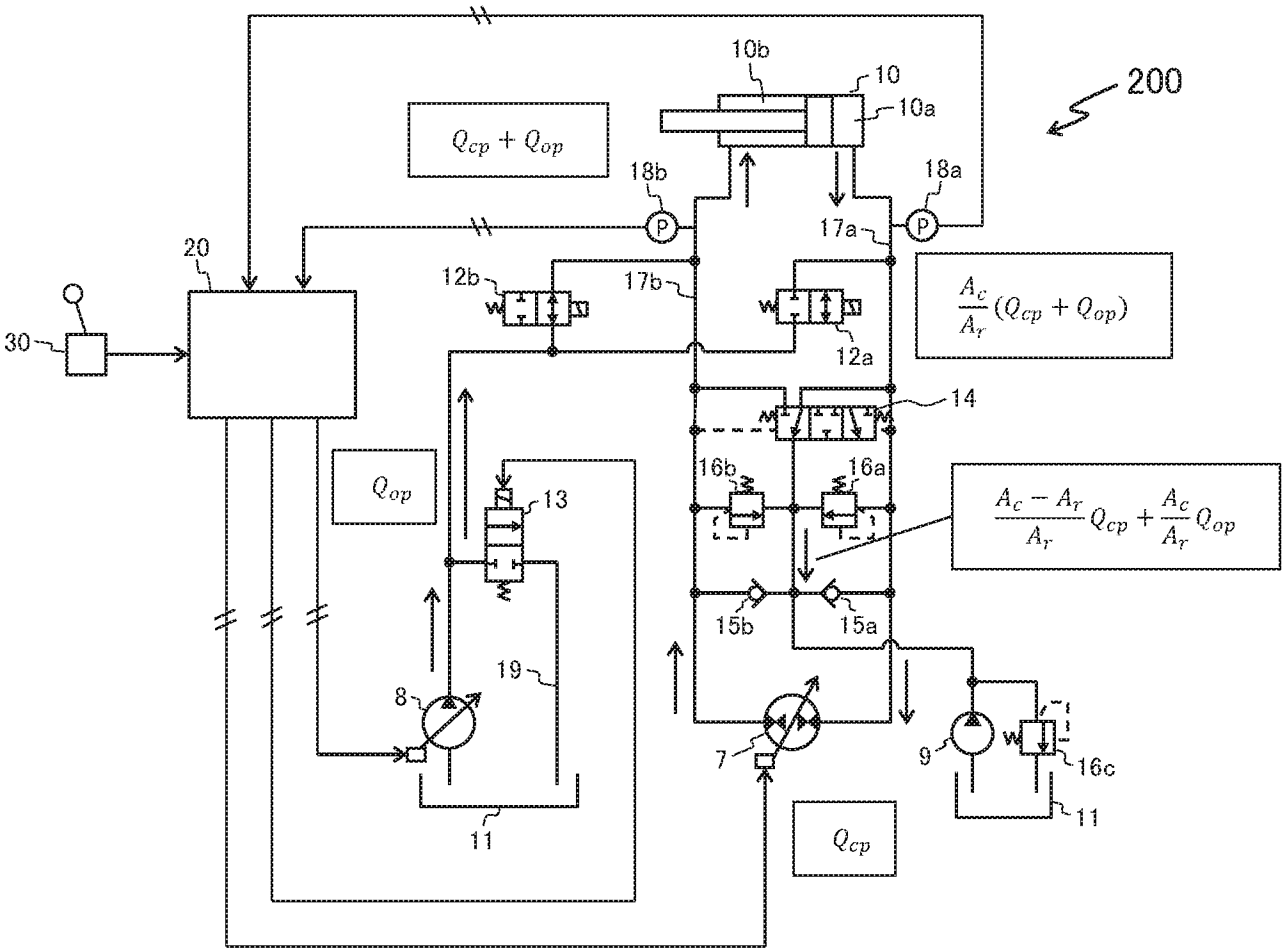
FIG. 7 is a view depicting a state when a rod assist action of the drive system depicted in FIG. 2 is being performed.

When the open circuit pump 8 is connected to the rod chamber 10*b* in this manner, the circuit state transitions to that of FIG. 7. Where the delivery flow rate of the closed circuit pump 7 is represented by Qcp and the delivery flow rate of the open circuit pump 8 is represented by Qop, since the flow rate flowing into the rod chamber 10*b* becomes Qcp+Qop, the flow rate discharged from the cap chamber 10*a* is given by

[Expression 4]

$$Ac/Ar\times(Qcp+Qop) \quad (4)$$

Since, simultaneously when the closed circuit pump 7 delivers the flow rate of Qcp to the rod chamber 10*b*, it sucks an equal flow rate from the cap chamber 10*a*, the flow rate passing the flushing valve 14 is given by

[Expression 5]

$$Ac/Ar\times(Qcp+Qop)-Qcp=(Ac-Ar)/Ar\times Qcp+Ac/Ar\times Qop \quad (5)$$

If Ar=1 and Ac=2 are assumed for the simplified description, then the expression (5) is represented as

[Expression 6]

$$Qcp+2\times Qop \quad (6)$$

Thus, it can be recognized that the passing flow rate of the flushing valve 14 is the sum of the flow rate of the closed circuit pump 7 and twice the flow rate of the open circuit pump 8. Incidentally, if the passing flow rate of the flushing valve 14 increases, then the pressure loss of the flushing valve 14 increases and the cap pressure increases. If the cap pressure increases, then the hydraulic force for displacing the flushing valve 14 to the opening side decreases, the cap side opening area of the flushing valve 14 decreases. This amplifies the pressure loss, and the displacement of the flushing valve 14 is reversed and the cylinder action becomes unstable.

Therefore, calculation by the rod assist flow rate restriction section 24 is performed. In the process F5, decision of whether or not the scheduled passing flow rate of the flushing valve 14 is higher than the permissible passing flow rate is performed. The scheduled passing flow rate is represented by the expression (5). The permissible passing flow rate is set in advance as a flow rate that can be fed to the flushing valve 14 with respect to the differential pressure obtained by subtracting the cap pressure from the rod pressure.

Figure 8:
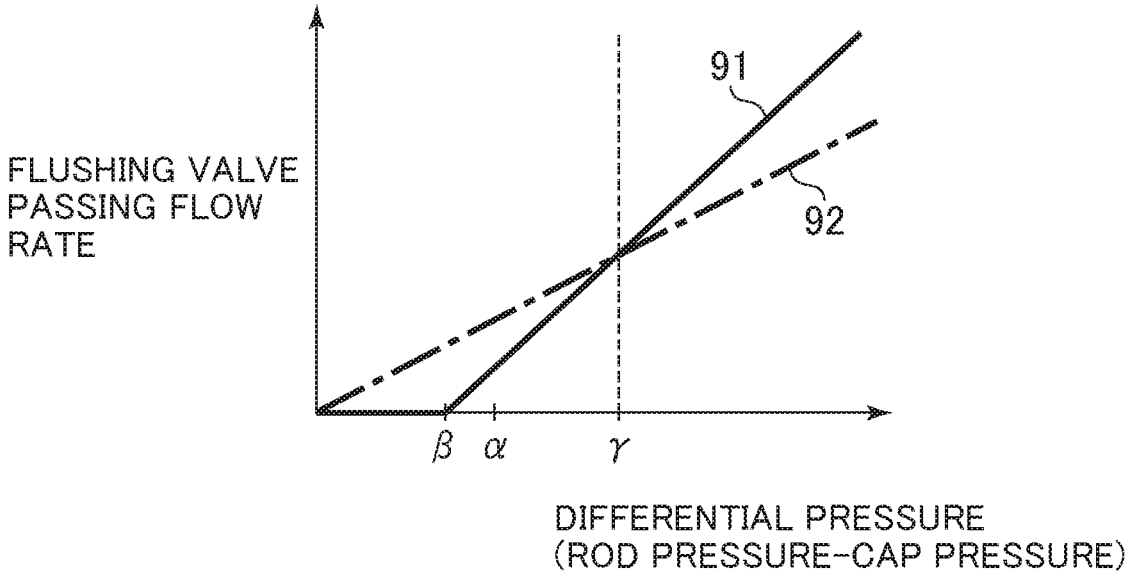
FIG. 8 is a view depicting an example of calculation of a rod assist flow rate restriction section depicted in FIG. 3.

This relation is described with reference to an example of FIG. 8. The axis of abscissa of FIG. 8 indicates the differential pressure obtained by subtracting the cap pressure from the rod pressure, and the axis of ordinate indicates the passing flow rate of the flushing valve 14. A solid line 91 indicates the permissible passing flow rate of the flushing valve 14, and a dash-dot line 92 indicates the scheduled passing flow rate of the flushing valve 14. When the differential pressure is lower than the selection setting pressure β of the flushing valve 14, since the flushing valve 14 is not open to the cap side hydraulic line 17*a*, the permissible passing flow rate 91 is zero. If the differential pressure exceeds the selection setting pressure β of the flushing valve 14, then the flushing valve 14 is opened to the cap side hydraulic line 17*a* and the permissible passing flow rate 91 increases according to the differential pressure. The scheduled passing flow rate 92 increases according to the differential pressure, and when the differential pressure is lower than γ, the scheduled passing flow rate 92 is higher than the permissible passing flow rate 91, and when the differential pressure is higher than γ, the scheduled passing flow rate 92 is lower than the permissible passing flow rate 91. Accordingly, when the differential pressure is higher than γ (after time t3 depicted in FIG. 6), since the scheduled passing flow rate 92 is lower than the permissible passing flow rate 91, the processing flow is ended by the process F5. At this time, the scheduled passing flow rate indicated by the expression (5) is discharged to the fluid tank 11 through the flushing valve 14. When the differential pressure is lower than γ (before time t3 depicted in FIG. 6), since the scheduled passing flow rate 92 is higher than the permissible passing flow rate 91, the processing advances to the process F6, where the delivery flow rate of the open circuit pump 8 is restricted. Consequently, since the scheduled passing flow rate is suppressed so as to be equal to or lower than the permissible passing flow rate, an excessively high flow rate equal to or higher than a presupposed level is not fed to the flushing valve 14, and the displacement of the flushing valve 14 and the cap pressure can be stabilized.

It is to be noted that the permissible passing flow rate is designed using such parameters as a driving pressure-displacement characteristic, a displacement-opening characteristic, a flow rate-pressure loss characteristic upon opening of the flushing valve 14 and a permissible upper limit value of the cap pressure so as to achieve balance between the cylinder speedup and the stabilized action.

With the hydraulic excavator 100 according to the present working example configured in such a manner as described above, in the case where the hydraulic cylinder 10 is operated in the contraction direction, the rod assist action is disabled when the cap chamber 10*a* of the hydraulic cylinder 10 is not communicated with the fluid tank 11 through the flushing valve 14, and the rod assist action is enabled when the cap chamber 10*a* is communicated with the fluid tank 11 through the flushing valve 14. Consequently, immediately after the rod assist action is started, part of a discharge flow rate of the cap chamber 10*a* begins to be returned to the fluid tank 11 through the flushing valve 14 and increase of the cap pressure is suppressed. Consequently, the contraction action of the hydraulic cylinder 10 can be speeded up stably.

Further, when the open circuit pump 8 is connected to the cap chamber 10*a* in the cylinder contraction action, the delivery flow rate of the open circuit pump 8 is restricted such that the surplus flow rate (scheduled passing flow rate) of the cap side hydraulic line is suppressed to a level equal to or lower than the permissible passing flow rate of the flushing valve 14, and therefore, increase of the cap pressure can be suppressed further.

WORKING EXAMPLE 2

A second working example of the present invention described below is directed to a case in which it is decided in the process F7 of FIG. 4 that the cap pressure of the hydraulic cylinder 10 is lower than the threshold value. In a state in which the rod assist action is not being performed (depicted in FIG. 5), the cylinder speed is controlled with the discharge flow rate of the cap chamber 10*a* (total flow rate of the suction flow rate of the closed circuit pump 7 and the discharge flow rate of the proportional valve 13).

At this time, if the flow rate Qbv of the proportional valve 13 becomes excessively high due to the cylinder speedup, then the cap pressure becomes excessively low and cavitation occurs on the suction side of the closed circuit pump 7, resulting in occurrence of a disadvantage that the pump is damaged or the like.

In order to prevent this, the proportional valve opening restriction section 23 (depicted in FIG. 4) restricts the opening of the proportional valve 13 in the case where the cap pressure becomes lower than the predetermined threshold value δ. As the threshold value, for example, a set pressure of the charge relief valve 16*c* is applicable. Since this suppresses the opening of the proportional valve 13 such that the cap pressure does not become lower than the threshold value, occurrence of cavitation described above can be prevented.

Although the embodiment of the present invention has been described in detail, the present invention is not limited to the embodiment described above but includes various modifications. For example, although the embodiment is described above taking a hydraulic excavator as an example, the present invention can be applied also to the construction machines other than the hydraulic excavator. Further, the embodiment described above has been described in detail in order to facilitate understanding of the present invention, the present invention does not necessarily need to include all components described hereinabove.

DESCRIPTION OF REFERENCE CHARACTERS

1A: Front implement
1B: Upper swing structure

1C: Lower track structure
1: Boom
2: Arm
3: Bucket
4: Boom cylinder (hydraulic cylinder)
5: Arm cylinder (hydraulic cylinder)
6: Bucket cylinder (hydraulic cylinder)
7: Closed circuit pump
8: Open circuit pump
9: Charge pump
10: Hydraulic cylinder
10*a:* Cap chamber
10*b:* Rod chamber
11: Fluid tank
12: Selector valve
13: Proportional valve
14: Flushing valve
15: Check valve
16*a,* 16*b:* Main relief valve
16*c:* Charge relief valve
17*a:* Cap side hydraulic line
17*b:* Rod side hydraulic line
18*a:* Cap side pressure sensor (cap pressure sensor)
18*b:* Rod side pressure sensor (rod pressure sensor)
19: Discharge hydraulic line
20: Controller
21: Valve and pump command generation section
22: Rod assist permission decision section
23: Proportional valve opening restriction section
24: Rod assist flow rate restriction section
25: Valve and pump command correction section
30: Operation lever
91: Flushing valve permissible passing flow rate
92: Flushing valve scheduled passing flow rate
100: Hydraulic excavator
200: Drive system

The invention claimed is:

1. A construction machine, comprising:

a single rod hydraulic cylinder having a cap chamber and a rod chamber;

a first hydraulic pump that is a bidirectionally tiltable variable displacement pump;

a cap side hydraulic line that connects one delivery port of the first hydraulic pump and the cap chamber to each other;

a rod side hydraulic line that connects another delivery port of the first hydraulic pump and the rod chamber to each other;

a fluid tank;

a flushing valve that discharges surplus fluid of one of the cap side hydraulic line and the rod side hydraulic line, that one is on a lower pressure side, to the fluid tank;

a second hydraulic pump that is a unidirectionally tiltable variable displacement pump;

a rod side selector valve that communicates a delivery port of the second hydraulic pump and the rod chamber with each other or interrupts the communication;

an operation lever for instructing an action of the hydraulic cylinder;

a cap pressure sensor that detects a pressure of the cap chamber;

a rod pressure sensor that detects a pressure of the rod chamber; and a controller for controlling the first hydraulic pump, the second hydraulic pump, and the rod side selector valve based on inputs from the operation lever, the cap pressure sensor, and the rod pressure sensor, wherein the controller is configured to, in a case where a contraction action of the hydraulic cylinder is instructed through the operation lever, close the rod side selector valve to disable a rod assist action for supplying hydraulic fluid from the second hydraulic pump to the rod chamber when a differential pressure obtained by subtracting the pressure of the cap chamber from the pressure of the rod chamber is equal to or lower than a first threshold value set to a level equal to or higher than a selection setting pressure of the flushing valve, and open the rod side selector valve to enable the rod assist action when the differential pressure is higher than the first threshold value.

2. The construction machine according to claim 1, wherein the controller includes a valve and pump command generation section that generates delivery flow rate commands for the first and second hydraulic pumps and an opening-closing command for the rod side selector valve based on inputs from the operation lever, the rod pressure sensor, and the cap pressure sensor, a rod assist permission decision section that, in a case where a contraction action of the hydraulic cylinder is instructed through the operation lever, decides that the rod assist action is enabled when the differential pressure is equal to or lower than the first threshold value, and decides that the rod assist action is disabled when the differential pressure is higher than the first threshold value, and a valve and pump command correction section that corrects, when the rod assist permission decision section decides that the rod assist action is enabled, the opening-closing command for the rod side selector valve generated by the valve and pump command generation section to an opening command, and corrects, when the rod assist permission decision section decides that the rod assist action is disabled, the opening-closing command for the rod side selector valve to a closing command.

3. The construction machine according to claim 2, wherein the controller further includes a rod assist flow rate restriction section that calculates a delivery flow rate of the second hydraulic pump such that, when the rod assist permission decision section decides that the rod assist action is enabled and besides a scheduled passing flow rate of the flushing valve based on the delivery flow rate command for the first hydraulic pump and the delivery flow rate command for the second hydraulic pump is higher than a permissible passing flow rate of the flushing valve according to the differential pressure, the scheduled passing flow rate is equal to or lower than the permissible passing flow rate, and the valve and pump command correction section corrects the delivery flow rate command for the second hydraulic pump generated by the valve and pump command generation section in accordance with the delivery flow rate of the second hydraulic pump calculated by the rod assist flow rate restriction section.

4. The construction machine according to claim 2, further comprising:

a cap side selector valve that communicates the delivery port of the second hydraulic pump and the cap chamber with each other or interrupts the communication; and a proportional valve provided in a discharge hydraulic line that connects the delivery port of the second hydraulic pump and the fluid tank to each other, the proportional valve being capable of continuously adjusting an opening area, wherein the valve and pump command correction section corrects, when the rod assist permission decision section decides that the rod assist action is disabled, the opening-closing command for the cap side selector valve generated by the valve and pump command generation section to an opening command such that discharge of fluid from the cap chamber to the fluid tank is enabled.

5. The construction machine according to claim 4, wherein the controller further includes a proportional valve opening restriction section that calculates, when the rod assist permission decision section decides that the rod assist action is enabled and besides the pressure of the cap chamber is lower than a predetermined second threshold value, such an opening area of the proportional valve that the pressure of the cap chamber becomes equal to or higher than the second threshold value, and the valve and pump command correction section corrects an opening command for the proportional valve in accordance with the opening area of the proportional valve calculated by the proportional valve opening restriction section.

* * * * *